US006010283A

United States Patent [19]

Henrich et al.

[11] Patent Number: 6,010,283

[45] **Date of Patent: *Jan. 4, 2000**

[54] CUTTING INSERT OF A CERMET HAVING A CO-NI-FE-BINDER

[75] Inventors: Hans-Wilm Henrich; Manfred Wolf; Dieter Schmidt, all of Bayreuth, Germany; Uwe Schleinkofer, Latrobe, Pa.

[73] Assignee: Kennametal Inc., Latrobe, Pa.

[ * ] Notice: This patent issued on a continued prosecution application filed under 37 CFR 1.53(d), and is subject to the twenty year patent term provisions of 35 U.S.C. 154(a)(2).

[21] Appl. No.: 08/918,982

[22] Filed: Aug. 27, 1997

[51] Int. Cl.[7] ..... B23B 27/14

[52] U.S. Cl. ..... 407/119; 407/118; 407/120; 428/212

[58] Field of Search ..... 407/118, 119, 407/120; 408/144, 145; 428/212

[56] References Cited

U.S. PATENT DOCUMENTS

| | | | |
|---|---|---|---|
| Re. 30,807 | 12/1981 | Elders | 299/86 |
| Re. 34,180 | 2/1993 | Nemeth et al. | 428/547 |
| 2,162,574 | 6/1939 | Dawihl et al. | 75/136 |
| 2,202,821 | 6/1940 | Bakle | 75/136 |
| 3,514,271 | 5/1970 | Yates | 29/182.5 |
| 3,816,081 | 6/1974 | Hale . | |
| 4,049,380 | 9/1977 | Yih et al. | 428/539.5 |
| 4,083,605 | 4/1978 | College et al. | 299/91 |
| 4,556,424 | 12/1985 | Viswanadham | 75/240 |
| 4,593,776 | 6/1986 | Salesky et al. | 175/375 |
| 4,642,003 | 2/1987 | Yoshimura | 408/144 |
| 4,743,515 | 5/1988 | Fisher et al. | 428/698 |
| 4,869,329 | 9/1989 | Kar et al. | 175/57 |
| 4,907,665 | 3/1990 | Kar et al. | 175/410 |
| 4,971,485 | 11/1990 | Nomura et al. | 408/144 |
| 5,066,553 | 11/1991 | Yoshimura et al. | 407/119 X |
| 5,186,739 | 2/1993 | Isobe et al. | 75/238 |
| 5,541,006 | 7/1996 | Conley | 428/552 |
| 5,658,395 | 8/1997 | Wahlberg et al. | 148/237 |
| 5,697,042 | 12/1997 | Massa et al. | 419/10 |
| 5,716,170 | 2/1998 | Kammermeier et al. | 408/145 |
| 5,766,742 | 6/1998 | Nakamura et al. | 407/119 X |
| 5,776,588 | 7/1998 | Moriguchi et al. | 407/119 X |
| 5,776,593 | 7/1998 | Massa et al. | 428/212 |
| 5,806,934 | 9/1998 | Massa et al. | 299/111 |
| 5,821,441 | 10/1998 | Kawamura | 75/248 |

FOREIGN PATENT DOCUMENTS

| | | |
|---|---|---|
| 1543214 | 10/1968 | France . |
| 29617040 | 3/1997 | Germany . |
| 46-15204 | 8/1971 | Japan . |
| 50-110909 | 7/1975 | Japan . |
| 53-21016 | 4/1978 | Japan . |
| 54-29900 | 3/1979 | Japan . |
| 61-194147 | 9/1986 | Japan . |
| 2273301 | 6/1994 | United Kingdom . |
| WO9621052 | 7/1996 | WIPO . |
| 9721844A | 6/1997 | WIPO . |

OTHER PUBLICATIONS

U.S. application No. 08/918,993, Heinrich et al., filed Aug. 27, 1997.

U.S. application No. 08/918,990, Heinrich et al., filed Aug. 27, 1997.

U.S. application No. 08/918,979, Heinrich et al., filed Aug. 27, 1997.

U.S. application No. 08/921,996, Heinrich et al., filed Aug. 27, 1997.

*Primary Examiner*—Andrea L. Pitts
*Assistant Examiner*—Henry W. H. Tsai
*Attorney, Agent, or Firm*—John J. Prizzi; Stanislav Antolin

[57] ABSTRACT

A cutting insert including a flank face, a rake face, and a cutting edge at the intersection of the flank and rake faces that is useful in the chip forming machining of workpiece materials is disclosed. The cutting insert comprises a cermet comprising at least one hard component and about 2 wt % to 19 wt % Co—Ni—FE-binder. The Co—Ni—FE-binder is unique in that even when subjected to plastic deformation, the binder substantially maintains its face centered cubic (fcc) crystal structure and avoids stress and/or strain induced transformations.

63 Claims, 1 Drawing Sheet

CUTTING INSERT OF A CERMET HAVING A CO-NI-FE-BINDER

BACKGROUND

Figure 1:
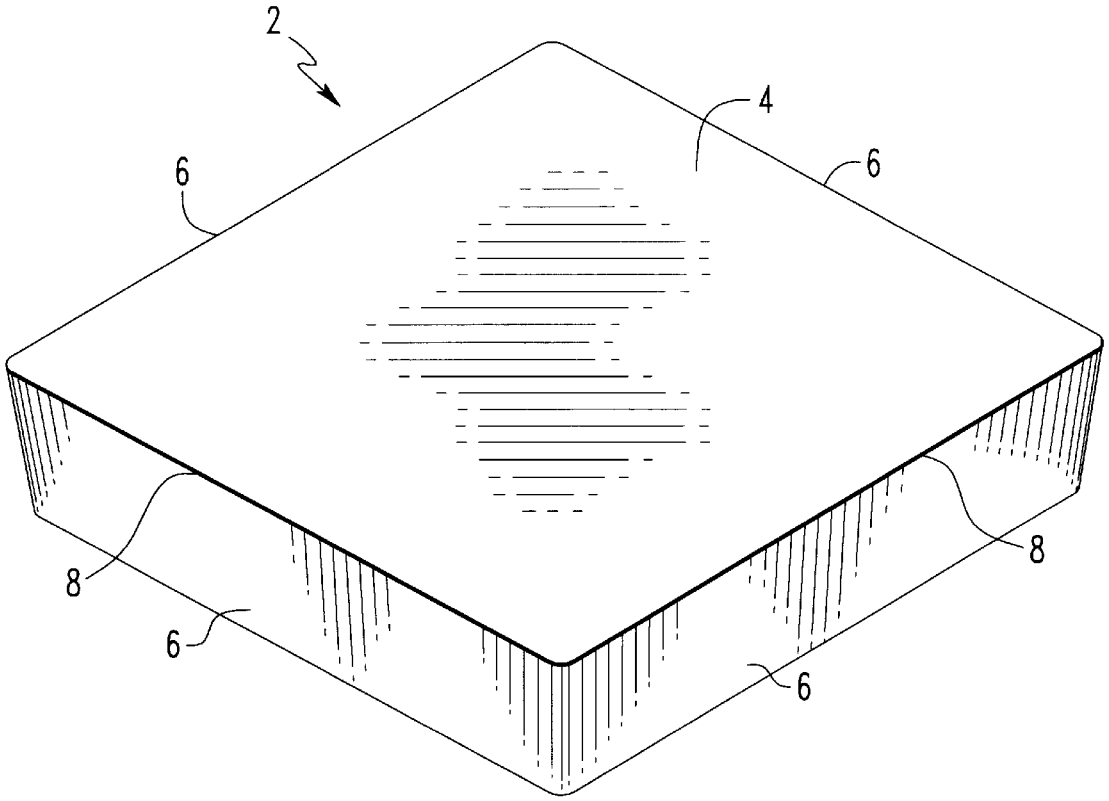

The present invention pertains to a cutting tool such as, for example, a milling insert or a cutting insert, comprising a flank face, a rake face, and a cutting edge at the intersection of the flank and rake faces, for chip form machining of workpiece materials. In the case of a milling insert, such a cutting tool has been typically used to mill workpiece materials. In the case of a cutting insert, such a cutting tool has been used to chip form machine workpiece materials.

For the most part when made from a cermet, cutting tools are comprised of tungsten carbide cermets (WC-cermets), also known as cobalt cemented tungsten carbide and WC-Co. Here, a cobalt binder (Co-binder) cements tungsten carbide particles together. Although WC-cermets have achieved successful results as a cutting tool, there are some drawbacks.

One drawback is that up to about 45 percent of the world's primary cobalt production is located in politically unstable regions (e.g., political regions that have experienced either armed or peaceful revolutions in the past decade and could still experience additional revolutions). About 15 percent of the world's annual primary cobalt market is used in the manufacture of hard materials including WC-cermets. About 26 percent of the world's annual primary cobalt market is used in the manufacture of superalloys developed for advanced aircraft turbine engines—a factor contributing to cobalt being designated a strategic material. These factors not only contribute to the high cost of cobalt but also explain cobalt's erratic cost fluctuations. Consequently, cobalt has been relatively expensive, which, in turn, has raised the cost of WC-cermet inserts which in turn has raised the cost of cutting tools. Such an increase in the cost of cutting tools has been an undesirable consequence of the use a Co-binder for WC-cermet inserts. Therefore, it would be desirable to reduce cobalt from the binder of cermets.

Furthermore, because of the principal locations of the largest cobalt reserves, there remains the potential that the supply of cobalt could be interrupted due to any one of a number of causes. The unavailability of cobalt would, of course, be an undesirable occurrence.

Cutting inserts may operate in environments that are corrosive. While WC-cermets having a Co-binder have been adequate in such corrosive environments, the development of a cutting tool that has improved corrosion resistance without losing any of the chip form machining performance remains an objective.

While the use of WC-cermets having a Co-binder for cutting tools has been successful, there remains a need to provide a material that does not have the drawbacks, i.e., cost and the potential for unavailability, inherent with the use of cobalt set forth above. There also remains a need to develop a cutting tool for use in corrosive environments that possess improved corrosion resistance without losing any of the cutting performance characteristics of cutting inserts made of WC-cermets having a Co-binder.

SUMMARY

An improved cermet comprising a cobalt-nickel-iron binder (Co—Ni—Fe-binder) having unexpected metal cutting performance, mechanical properties, and physical properties over the prior art has been discovered. The discovery is surprising in that the Co—Ni—Fe-binder comprises a composition that is contrary to the teaching of the prior art. More particularly, the inventive cermet for cutting tools comprises about 2 weight percent (wt. %) to about 19 wt. % Co—Ni—Fe-binder (a more typical range comprises about 5 wt. % to about 14 wt. % and a narrower typical range comprises about 5.5 wt. % to about 11 wt. %) and about 81 wt. % to about 98 wt. % hard component. The hard component comprises at least one of borides, carbides, nitrides, oxides, silicides, their mixtures, their solid solutions, and combinations of the preceding. Preferably, the hard component comprises at least one of carbides and carbonitrides, for example, such as tungsten carbide and/or titanium carbonitride optionally with other carbides (e.g., TaC, NbC, TiC, VC, $Mo_2C$, $Cr_2C_3$) present as simple carbides and/or in solid solution.

Cutting tools for the chip forming machining of workpiece materials, such as metals, metal alloys, and composites comprising one or more of metals, polymers, and ceramics, are composed of the foregoing compositions. The cutting tools in accordance with the present invention have a flank face and a rake face over which chips, formed during chip forming machining, flow. At a juncture of the rake face and flank face, a cutting edge is formed for cutting into workpiece materials to form chips.

The invention illustratively disclosed herein may suitably be practiced in the absence of any element, step, component, or ingredient which is not specifically disclosed herein.

DRAWINGS

Figure 2:
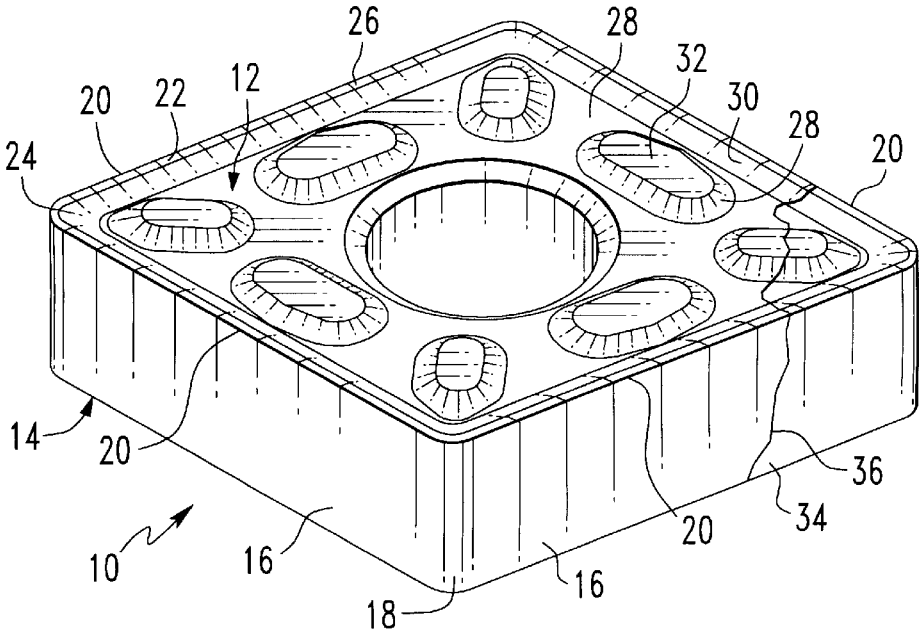

These and other features, aspects, and advantages of the present invention will become better understood with reference to the following description, appended claims, and accompanying drawings where:

FIG. 1 shows an embodiment of a cutting tool in accordance with the present invention; and FIG. 2 shows an embodiment of a cutting tool with chip control surfaces integrally molded in the tool in accordance with the present invention.

DESCRIPTION

In accordance with the present invention, FIG. 1 shows an embodiment of an indexable cutting insert 2 composed of a cermet having a cobalt-nickel-iron-binder (Co—Ni—Fe-binder). The cutting insert 2 is used in the chip forming machining (e.g. turning, milling, grooving and threading) of workpiece materials including metals, polymers, and composites having a metallic or polymeric matrix. This invention is preferably used in the machining of metallic workpiece materials (see e.g., KENNAMETAL Lathe Tooling Catalog 6000 and KENNAMETAL Milling Catalog 5040), and is particularly useful in roughing and interrupted cutting of these workpiece materials where a combination of high toughness and high wear resistance is required. The cutting insert 2 has a rake face 4 over which chips, formed during high speed machining of workpiece materials, flow. Joined to the rake surface 4 are flank faces 6. At the juncture of the rake face 4 and the flank faces 6 is formed a cutting edge 8 for cutting into the workpiece materials. The cutting edge 8 may be in either a sharp, honed, chamfered or chamfered and honed condition depending on application requirements. The hone may be any of the style or sizes of hones used in the industry. The cutting insert may also be made in standard shapes and sizes (for example SNGN-434T, SNGN-436T, SPGN-633T, SPGN-634T, inserts may also be made with holes therein as well).

For example, as depicted in FIG. 2, the substrate may comprise an indexable cutting insert 10 comprising a polygonal body with a top surface 12, a bottom surface 14, and a peripheral wall with sides 16 and corners 18 extending from the top surface 12 to the bottom surface 14. At an intersection of the peripheral wall and the top surface 12 is a cutting edge 20. The top surface 12 comprises a land area 22 joining the cutting edge 20 and extending inwardly toward the center of the body. The land area 22 is comprised of corner portion land areas 24 and side portion land areas 22. The top surface 12 also comprises a floor 28 between the land area 22 and the center of the body, which is disposed at a lower elevation than the land area 22. The top surface 12 may further comprise sloping wall portions 30 inclined downwardly and inwardly from the land area 22 to the floor 28. A plateau or plateaus 32 may be disposed upon the floor 28 spaced apart from the sloping wall portions 30 and having sloped sides ascending from the floor 28. Furthermore, the bottom surface 14 of the body may have features similar to those described for the top surface 12. Regardless of its shape, the cermet 34 comprising an indexable cutting insert 10 may be at least partially coated with a coating scheme 36 and preferably in portions that contact the material to be machined and/or that has been machined A cutting tool of the present invention may be advantageously used at cutting speeds, feeds, and depths of cut (DOC) that are compatible with achieving the desired results. Furthermore, the cutting tools of the present invention may be used either with or without a cutting or cooling fluid.

The cermet from which the cutting insert 2 of FIG. 1 or the hard insert 10 of FIG. 2 are made of a cermet comprising a cobalt-nickel-iron binder and at least one hard component. The Co—Ni—Fe-binder is unique in that even when subjected to plastic deformation, the binder maintains its face centered cubic (fcc) crystal structure and avoids stress and/or strain induced transformations. Applicants have measured strength and fatigue performance in cermets having Co—Ni—Fe-binders up to as much as about 2400 megapascal (MPa) for bending strength and up to as much as about 1550 MPa for cyclic fatigue (200,000 cycles in bending at about room temperature). Applicants believe that substantially no stress and/or strain induced phase transformations occur in the Co—Ni—Fe-binder up to those stress and/or strain levels that leads to superior performance.

Applicants believe that in the broadest sense the Co—Ni—Fe-binder comprises at least about 40 wt. % cobalt but not more than 90 wt. % cobalt, at least about 4 wt. % nickel, and at least about 4 wt. % iron. Applicant believes that the Co—Ni—Fe-binder comprising not more than about 36 wt. % Ni and not more than about 36 wt. % Fe is preferred. A preferred Co—Ni—Fe-binder comprises about 40 wt. % to 90 wt. % Co, about 4 wt. % to 36 wt. % Ni, about 4 wt. % to 36 wt. % Fe, and a Ni:Fe ratio of about 1.5:1 to 1:1.5. A more preferred Co—Ni—Fe-binder comprises about 40 wt. % to 90 wt. % Co and a Ni:Fe ratio of about 1:1. An other more preferred Co—Ni—Fe-binder comprises a cobalt:nickel:iron ratio of about 1.8:1:1.

It will be appreciated by those skilled in the art that the Co—Ni—Fe-binder may also comprise at least one secondary alloying element either in place of one or both of nickel and iron and/or in a solid solution with the Co—Ni—Fe-binder and/or as discrete precipitates in the Co—Ni—Fe-binder. Such at least one secondary alloying element may contribute the physical and/or mechanical properties of the cermet. Whether or not the at least one secondary alloying element contributes to the properties of the cermet, the least one secondary alloying element may be included in the Co—Ni—Fe-binder to the extent that the least one secondary alloying element does not detract from the properties and/or performance of the cutting tool.

The range of the Co—Ni—Fe-binder in the cermet comprises about 2 wt. % to about 19 wt. %. A more preferred range of Co—Ni—Fe-binder comprises about 5 wt. % to about 14 wt. %. An even more preferred range of the Co—Ni—Fe-binder in the cermet comprises about 5.5 wt. % to about 11 wt. %.

The hard component of the cermet of the present invention may comprise borides(s), carbide(s), nitride(s), oxide (s), silicide(s), their mixtures, their solid solutions (e.g., carbonitride(s), borocarbide(s), oxynitride(s), borocarbonitride(s) . . . etc.), or any combination of the preceding. The metal of these may comprise one or more metals from International Union of Pure and Applied Chemistry (IUPAC) groups 2, 3 (including lanthanides and actinides), 4, 5, 6, 7, 8, 9, 10, 11, 12, 13, and 14. Preferably the hard component comprises one or more of carbide(s), nitride(s), carbonitride(s), their mixture(s), their solid solution(s), or any combination of the preceding. The metal of the carbide(s), nitride(s), and carbonitrides(s) may comprise one or more metal from IUPAC groups 3 (including lanthanides and actinides), 4, 5, and 6; preferably, one or more of Ti, Zr, Hf, V, Nb, Ta, Cr, Mo, and W; and more preferably one or more of Ti, Ta, Nb, and W.

In this context, the inventive cermets may be referred to by the composition making up a majority of the hard component. For example, if a majority of the hard component comprises a carbide, the cermet may be designated a carbide-cermet. If a majority of the hard component comprises tungsten carbide (WC), the cermet may be designated a tungsten carbide cermet or WC-cermet. In a like manner, when a majority of the hard component comprises a carbonitride, the cermet may also be designated a carbonitride-cermet. For example, when a majority of the hard component comprises titanium carbonitride, the cermet may be designated a titanium carbonitride-cermet or TiCN-cermet.

The grain size of the hard component comprises a broadest range of about 0.1 micrometers ($\mu$m) to 40 $\mu$m. A mediate range for the grain size of the hard component comprises about 0.5 $\mu$m to 10 $\mu$m. Another mediate range for the grain size of the hard component comprises about 1 $\mu$m and 5 $\mu$m. Applicants believe that the above ranges of hard component grain size are particularly applicable to WC-cermets having a Co—Ni—Fe-binder.

Applicants contemplate that every increment between the endpoints of ranges disclosed herein, for example, binder content, binder composition, Ni:Fe ratio, hard component grain size, hard component content, . . . etc. is encompassed herein as if it were specifically stated. For example, a binder content range of about 2 wt. % to 19 wt. % encompasses about 1 wt. % increments thereby specifically including about 2 wt. %, 3 wt. %, 4 wt. %, . . . 17 wt. %, 18 wt. % and 19 wt. % binder. While for example, for a binder composition the cobalt content range of about 40 wt. % to 90 wt. % encompasses about 1 wt. % increments thereby specifically including 40 wt. %, 41 wt. %, 42 wt. %, . . . 88 wt. %, 89 wt. %, and 90 wt. % while the nickel and iron content ranges of about 4 wt. % to 36 wt. % each encompass about 1 wt. % increments thereby specifically including 4 wt. %, 5 wt. %, 6 wt. %, . . . 34 wt. %, 35 wt. %, and 36 wt. %. Further for example, a Ni:Fe ratio range of about 1.5:1 to 1:1.5 encompasses about 0.1 increments thereby specifically including 1.5:1, 1.4:1, . . . 1:1, . . . 1:1.4, and 1:1.5). Furthermore for example, a hard component grain size range of about 0.1 μm to about 40 μm encompasses about 1 μm increments thereby specifically including about 0.1 μm, 1 μm, 2 μm, 3 μm, . . . 38 μm, 39 μm, and 40 μm.

A cermet cutting tool of the present invention may be used either with or without a coating. If the cutting tool is to be used with a coating, then the cutting tool is coated with a coating that exhibits suitable properties such as, for example, lubricity, wear resistance, satisfactory adherence to the cermet, chemical inertness with workpiece materials at material removal temperatures, and a coefficient of thermal expansion that is compatible with that of the cermet (i.e., compatible thermo-physical properties). The coating may be applied via CVD and/or PVD techniques.

Examples of the coating material, which may comprise one or more layers of one or more different components, may be selected from the following, which is not intended to be all-inclusive: alumina, zirconia, aluminum oxynitride, silicon oxynitride, SiAlON, the borides of the elements for IUPAC groups 4, 5, and 6, the carbonitrides of the elements from IUPAC groups 4, 5, and 6, including titanium carbonitride, the nitrides of the elements from IUPAC groups 4, 5, and 6 including titanium nitride, the carbides of the elements from IUPAC groups 4, 5, and 6 including titanium carbide, cubic boron nitride, silicon nitride, carbon nitride, aluminum nitride, diamond, diamond like carbon, and titanium aluminum nitride.

The significant advantages of the present invention are further indicated by the following examples which are intended to be purely illustrative of the present invention.

As summarized in Table 1, a WC-cermet having a Co—Ni—Fe-binder of this invention and a comparative conventional WC-cermet were produced using conventional powder technology as decried in, for example, "World Directory and Handbook of HARDMETALS AND HARD MATERIALS" Sixth Edition, by Kenneth J. A. Brookes, International Carbide DATA (1996); "PRINCIPLES OF TUNGSTEN CARBIDE ENGINEERING" Second Edition, by George Schneider, Society of Carbide and Tool Engineers (1989); "Cermet-Handbook", Hertel AG, Werkzeuge+ Hartstoffe, Fuerth, Bavaria, Germany (1993); and "CEMENTED CARBIDES", by P. Schwarzkopf & R. Kieffer, The Macmillan Company (1960)–the subject matter of which is herein incorporated by reference in it entirety. In particular, Table 1 presents a summary of the nominal binder content in weight percent (wt. %), the nominal binder composition, and the hard component composition and amount (wt. %) for a composition of this invention and a comparative prior art composition. That is, commercially available ingredients that had been obtained for each of the inventive and the conventional composition as described in Table 1 were combined independent attritor mills with hexane for homogeneous blending over a period of 12 hours. After each homogeneously blended mixture of ingredients was appropriately dried, green bodies having the form of cutting inserts and plates for properties evaluation were pressed . The green bodies were densified by pressure-sintering (also known as sinter-HIP) at about 1450° C. for about 1.5 hours (during the last 10 minutes at about 1450° C. the furnace pressure was raised to about 4 MPa). After densification, the sintered bodies were processed by, for example, cutting, grinding, and honing, to prepare specimens for properties and cutting tool evaluation.

Table 2 presents a summary of the results of properties evaluation including the density (g/cm$^3$), the magnetic saturation (0.1 μTm$^3$/kg), the coercive force (Oe, measured substantially according to International Standard ISO 3326: Hardmetals—Determination of (the magnetization) coercivity), the hardness (Hv$_{30}$, measured substantially according to International Standard ISO 3878: Hardmetals—Vickers hardness test), the transverse rupture strength (MPa, measured substantially according to International Standard ISO 3327/Type B: Hardmetals—Determination of transverse rupture strength) and the porosity (measured substantially according to International Standard ISO 4505: Hardmetals—Metallographic determination of porosity and uncombined carbon) for the inventive and the conventional compositions of Table 1.

TABLE 1

Nominal Composition for Invention & Comparative Conventional WC-Cermet

| | Nominal Binder | Nominal Binder Composition | | | Hard Component Composition and amount (wt. %) | | |
|---|---|---|---|---|---|---|---|
| | Content | (wt. %) | | | | | WC |
| Sample | (wt. %) | Co | Ni | Fe | TiC | Ta(Nb)C | 8 μm |
| Invention | 6.0 | 3.4 | 1.3 | 1.3 | 2.5 | 5.0 | 86.5 |
| Conventional | 6.0 | 6.0 | 0.0 | 0.0 | 2.5 | 5.0 | 86.5 |

TABLE 2

Mechanical & Physical Properties for Invention & Comparative Conventional WC-Cermet Compositions of Table 1

| Sample | Density (g/cm$^3$) | Magnetic Saturation 0.1 μTm$^3$/kg | Hc (Oe) | Hardness (HV30) | TRS (MPa) | Porosity |
|---|---|---|---|---|---|---|
| Invention | 13.95 | 116 | 62 | 1420 | 2754 | <A02 |
| Conventional | 14.01 | 111 | 150 | 1460 | 2785 | <A02 |

As noted above, the inventive and conventional WC-cermets of Table 1 were produced in the form of cutting inserts. In particular, the cutting insert style comprised CNMG120412 (based on International Standard ISO 1832: Indexable inserts for cutting tool—Designation). Some cutting inserts made from each of the inventive and the conventional WC-cermets were tested using an interrupted cutting procedure that provided an evaluation of comparative toughness in use. This interrupted cutting procedure (Leistendrehtest performed as substantially disclosed by W. König, K. Gerschwiler, R. v. Haas, H. Kunz, J. Schneider, G. Kledt, R. Storf, and A. Thelin in "Beurteilung des Z ähigkeitsverhaltens von Schneidstoffen im unterbrochenen Schnitt" VDI BERICHTE NR. 762 (1989) starting at page 127 available from Verlag des Deutscher Ingenieure Dusseldorf, Germany) involved using a workpiece material with clamped bars so that the cutting insert experienced interrupted cutting under the conditions summarized in Table 3. The test was performed so that the feed rate was increased from about 0.40 mm/rev. to 0.90 mm/rev. at increments of about 0.1 mm/rev. after the cutting insert experienced about 100 impacts at the designated feed rate. Five cutting insert of each WC-cermet were tested. All of the tested cutting inserts of both the inventive and the WC-cermet reached the feed rate of about 0.90 mm/rev. without catastrophically failing.

TABLE 3

| Comparative Toughness Test Conditions for Invention & Comparative Conventional Cermet of Table 1: | |
|---|---|
| Workpiece Material | CK60 |
| Cutting Speed | 200 m/min |
| Feed Rate | 0.40, 0.50 . . . 0.90 mm/rev. increasing 0.1 mm/rev. 100 impacts per feed rate |
| Depth of Cut | 2.5 mm |
| Coolant | none |

Additionally, cutting inserts comprising the inventive and the conventional WC-cermets were coated with a first about 4 $\mu$m titanium carbonitride (TiCN) layer followed by a second about 8 $\mu$m aluminum oxide ($Al_2O_3$) layer, both of which were applied by commercially known conventional chemical vapor deposition (CVD). Five CVD TiCN/CVD $Al_2O_3$ coated cutting inserts of each WC-cermet were subjected to the comparative toughness test summarized in Table 3. As with the uncoated cutting inserts, the feed rate was increased until the cutting inserts failed. The average feed rate at failure for the CVD TiCN/CVD $Al_2O_3$, coated cutting inserts comprising the WC-cermet having the Co—Ni—Fe-binder was about 0.76 mm/rev. The average feed rate at failure for the CVD TiCN/CVD $Al_2O_3$ coated cutting inserts comprising the WC-cermet having the Co-binder was about 0.74 mm/rev.

Five CVD TiCN/CVD $Al_2O_3$ coated cutting inserts of each WC-cermet were subjected to a comparative toughness endurance test as summarized in Table 4, in which one cutting insert edge was subjected to about 18,000 impacts. All of the CVD TiCN/CVD $Al_2O_3$ coated cutting inserts of both WC-cermets survived about 18,000 impacts without catastrophically failing.

TABLE 4

| Comparative Toughness Endurance Test Conditions for Invention & Comparative Conventional WC-Cermet of Table 1: | |
|---|---|
| Workpiece Material | CK60 |
| Cutting Speed | 100 m/min |
| Feed Rate | 0.4 mm/rev. constant |
| Depth of Cut | 1.5 mm |
| Coolant | none |

As summarized in Table 5, TiCN-cermets having a Co—Ni—Fe-binder of the invention and a comparative TiCN-cermet having a Co—Ni-binder were produced using conventional powder technology as described by, for example, K. J. A. Brookes; G. Schneider; and P.

Schwarzkopf et al.—mentioned above. In particular, Table 5 presents a summary of the nominal binder content in weight percent (wt. %), the nominal binder composition, and the hard component composition and amount (wt. %) for a TiCN-cermet of this invention and a comparative prior art composition. That is, commercially available ingredients that had been obtained for each of the inventive and the conventional composition as described in Table 1 were combined in independent attritor mills with hexane for homogeneous blending over a period of about 13 hours. After each homogeneously blended mixture of ingredients was appropriately dried, green bodies having the form of a cutting inserts and plates for properties evaluation were pressed. The green bodies were densified by pressure-sintering (also known as sinter-HIP) a about 1435° C. for about 1.5 hours (during the last 10 minutes at about 1435° C. the furnace pressure was raised to about 4 MPa). After densification, the sintered bodies were processed by, for example, cutting, grinding, and honing, to prepare specimens for properties and cutting tool evaluation.

TABLE 5

| Nominal Composition for Invention & Comparative Conventional TiCN-Cermet | | | | | | | |
|---|---|---|---|---|---|---|---|
| | Nominal Binder | Nominal Binder Composition | | | Hard Component Composition and amount (wt. %) | | |
| | Content | (wt. %) | | | | | WC + |
| Sample | (wt. %) | Co | Ni | Fe | TiCN | Ta(Nb)C | $Mo_2C$ |
| Invention | 18.0 | 10.0 | 4.0 | 4.0 | 58.0 | 8.0 | 16.0 |
| Conventional | 18.0 | 12.0 | 6.0 | 0.0 | 58.0 | 8.0 | 16.0 |

Table 6 presents a summary of the results of properties evaluation including density (g/Cm$^3$), magnetic saturation (0.1 $\mu$Tm$^3$/kg), coercive force (Hc, oersteds), Vickers Hardness (HV30), transverse rupture strength (TRS in megapascal (MPa)) and porosity for the inventive and the conventional TiCN-cermets of Table 5.

TABLE 6

| Mechanical & Physical Properties for Invention & Comparative Conventional TiCN-Cermet of Table 5 | | | | | | |
|---|---|---|---|---|---|---|
| Sample | Density (g/cm$^3$) | Magnetic Saturation 0.1 $\mu$Tm$^3$/kg | Hc (Oe) | Hardness (HV30) | TRS (MPa) | Porosity |
| Invention | 6.37 | 250 | 84 | 1430 | 2594 | <A02 |
| Conventional | 6.66 | 113 | 116 | 1450 | 2508 | <A02 |

As noted above, the inventive and conventional TiCN-cermets of Table 5 were produced in the form of cutting inserts. In particular, the cutting insert style comprised CNMG120408 (based on International Standard ISO 1832: Indexable inserts for cutting tool—Designation). Some cutting inserts made from each of the inventive and the conventional TiCN-cermets were tested using an interrupted cutting procedure that provided an evaluation of comparative toughness in use. This interrupted cutting procedure involved using a workpiece material with clamped bars so that the cutting insert experienced interrupted cutting under the conditions summarized in Table 7. The test was performed so that the feed rate was increased from about 0.10 mm/rev. to breakage at increments of about 0.05 mm/rev. after the cutting insert experienced about 100 impacts at the designated feed rate. Five cutting insert of each composition were tested. Additional cutting inserts were tested in a turning test in which the cutting speed was continually increased up to the failure of the inserts.

TABLE 7

| Comparative Fracture Toughness Test Conditions for Invention & Comparative Conventional Cermet of Table 5: | | |
|---|---|---|
| | Increasing Feed Rate Test | Increasing Cutting Speed Test |
| Workpiece Material | CK60 | 50CrV4 (1.8159) |
| Cutting Speed | 200 m/min | 260, 280 . . . m/min |

TABLE 7-continued

| Comparative Fracture Toughness Test Conditions for Invention & Comparative Conventional Cermet of Table 5: | | | | |
|---|---|---|---|---|
| Feed Rate | 0.10, 0.15 . . . to breakage increasing 0.05 mm/rev. after 100 impacts at feed rate | | 0.3 mm/rev. | |
| Depth of Cut | 2.0 mm | | 2.0 mm | |
| Coolant | none | | none | |
| Average Results for | Toughness Achieved Feed Rate (mm/rev.) | | Achieved Cutting Speed Vc (m/min)) | |
| Five Inserts | Invention | Cnvntnl | Invention | Cnvntnl |
| | 0.32 | 0.36 | 304 | 312 |

The patents and other documents identified herein, including U.S. patent application Ser. No. 08/918,993 entitled, "A CERMET HAVING A BINDER WITH IMPROVED PLASTICITY", by Hans-Wilm Heinrich, Manfred Wolf, Dieter Schmidt, and Uwe Schleinkofer (the applicants of the present patent application) which was filed on the same date as the present patent application and assigned to Kennametal Inc. (the same assignee as the assignee of the present patent application), are hereby incorporated by reference herein.

Other embodiments of the invention will be apparent to those skilled in the art from a consideration of the specification or practice of the invention disclosed herein. It is intended that the specification and examples be considered as illustrative only, with the true scope and spirit of the invention being indicated by the following claims.

What is claimed is:

1. A cutting tool for chip forming machining of workpiece materials, the cutting tool comprising:

a rake face over which chips formed during the chip forming machining of workpiece materials flow;

a flank face; and a cutting edge, for cutting into the workpiece materials to form the chips, formed at a junction of the rake face and the flank face, Wherein at least the rake face, the flank face and the cutting edge of the cutting tool comprise a cermet comprising at least one hard component and about 2 wt. % to about 19 wt. % Co—Ni—Fe-binder comprising about 40 wt. % to about 90 wt. % cobalt, about 4 wt. % to about 36 wt. % nickel, about 4 wt. % to about 36 wt. % iron, and a cobalt:nickel:iron ratio of about 1.8:1:1.

2. The cutting tool of claim 1 wherein the cermet comprises about 5 wt. % to about 14 wt. % binder.

3. The cutting tool of claim 1 wherein the cermet comprises about 5.5 wt. % to about 11 wt. % binder.

4. The cutting tool of claim 1 wherein the Co—Ni—Fe-binder comprises a face centered cubic (fcc) structure that substantially maintains its fcc structure when subjected to plastic deformation thereby exhibiting substantially no stress and strain induced phase transformations.

5. The cutting tool of claim 1 wherein the Co—Ni—Fe-binder comprises a face centered cubic (fcc) structure that substantially maintains its fcc structure when the cermet is subjected to a bending strength test under up to as much as about 2400 megapascal (MPa).

6. The cutting tool of claim 1 wherein the Co—Ni—Fe-binder comprises a face centered cubic (fcc) structure that substantially maintains its fcc structure when the cermet is subjected to up to about 200,000 cycles at up to about 1550 megapascal (MPa) in a cyclic fatigue test in bending at about room temperature.

7. The cutting tool of claim 3 wherein the Co—Ni—Fe-binder comprises a milling insert or a cutting insert.

8. The cutting tool of claim 1 wherein the hard component has a grain size comprising about 0.1 $\mu$m to about 40 $\mu$m.

9. The cutting tool of claim 1 wherein the hard component has a grain size comprising about 0.5 $\mu$m to about 10 $\mu$m.

10. The cutting tool of claim 1 wherein the hard component has a grain size comprising about 1 $\mu$m to about 5 $\mu$m.

11. A cutting tool for chip forming machining of workpiece materials, the cutting tool comprising:

a rake face over which chips formed during the chip forming machining of workpiece materials flow;

a flank face; and a cutting edge, for cutting into the workpiece materials to form the chips, formed at a junction of the rake face and the flank face, wherein at least the rake face, the flank face, and the cutting edge comprise a WC-cermet comprising tungsten carbide and about 2 wt. % to about 19 wt. % Co—Ni—Fe-binder comprising about 40 wt. % to about 90 wt. % cobalt, about 4 wt. % to about 36 wt. % nickel, about 4 wt. % to about 36 wt. % iron, and a cobalt:nickel:iron ratio comprising 1.8:1:1.

12. The cutting tool of claim 11 wherein the WC-cermet comprises about 5 wt. % to about 14 wt. % binder.

13. The cutting tool of claim 11 wherein the WC-cermet comprises about 5.5 wt. % to about 11 wt. % binder.

14. The cutting tool of claim 11 wherein the Co—Ni—Fe-binder comprises a face centered cubic (fcc) structure that substantially maintains its fcc structure when subjected to plastic deformation thereby exhibiting substantially no stress and strain induced phase transformations.

15. The cutting tool of claim 11 wherein the Co—Ni—Fe-binder comprises a face centered cubic (fcc) structure that substantially maintains its fcc structure when the cermet is subjected to a bending strength test under up to as much as about 2400 megapascal (MPa).

16. The cutting tool of claim 11 wherein the Co—Ni—Fe-binder comprises a face centered cubic (fcc) structure that substantially maintains its fcc structure when the cermet is subjected to up to about 200,000 cycles at up to about 1550 megapascal (MPa) in a cyclic fatigue test in bending at about room temperature.

17. The cutting tool of claim 11 wherein the Co—Ni—Fe-binder comprises a milling insert or a cutting insert.

18. The cutting tool of claim 11 wherein the tungsten carbide has a grain size comprising about 0.1 $\mu$m to about 40 $\mu$m.

19. The cutting tool of claim 11 wherein the tungsten carbide has a grain size comprising about 0.5 $\mu$m to about 10 $\mu$m.

20. The cutting tool of claim 11 wherein the tungsten carbide has a grain size comprising about 1 $\mu$m to about 5 $\mu$m.

21. A cutting tool for chip forming machining of workpiece materials, the cutting tool comprising:

a rake face over which chips formed during the chip forming machining of workpiece materials flow;

a flank face; and a cutting edge, for cutting into the workpiece materials to form the chips, formed at a junction of the rake face and the flank face, wherein at least the rake face, the flank face, and the cutting edge comprise a TiCN-cermet comprising titanium carbonitride and about 2 wt. % to about 19 wt. % Co—Ni—Fe-binder comprising about 40 wt. % to about 90 wt. % cobalt, about 4 wt. % to about 36 wt. % nickel, about 4 wt. % to about 36 wt. % iron, and a cobalt:nickel:iron ratio of about 1.8:1:1.

22. The cutting tool of claim 21 wherein the TiCN-cermet comprises about 5 wt. % to about 14 wt. % binder.

23. The cutting tool of claim 21 wherein the TiCN-cermet comprises about 5.5 wt. % to about 11 wt. % binder.

24. The cutting tool of claim 21 wherein the Co—Ni—Fe-binder comprises a face centered cubic (fcc) structure that substantially maintains its fcc structure when subjected to plastic deformation thereby exhibiting substantially no stress and strain induced phase transformations.

25. The cutting tool of claim 21 wherein the Co—Ni—Fe-binder comprises a face centered cubic (fcc) structure that substantially maintains its fcc structure when the cermet is subjected to a bending strength test under up to as much as about 2400 megapascal (MPa).

26. The cutting tool of claim 21 wherein the Co—Ni—Fe-binder comprises a face centered cubic (fcc) structure that substantially maintains its fcc structure when the cermet is subjected to up to about 200,000 cycles at up to about 1550 megapascal (MPa) in a cyclic fatigue test in bending at about room temperature.

27. The cutting tool of claim 21 wherein the Co—Ni—Fe-binder comprises a milling insert or a cutting insert.

28. The cutting tool of claim 21 wherein the titanium carbonitride has a grain size comprising about 0.1 μm to about 40 μm.

29. The cutting tool of claim 21 wherein the titanium carbonitride has a grain size comprising about 0.5 μm to about 10 μm.

30. The cutting tool of claim 21 wherein the titanium carbonitride has a grain size comprising about 1 μm to about 5 μm.

31. The cutting tool of claim 11 further comprising acoating on at least a portion of the WC-cermet.

32. The cutting tool of claim 31 wherein the coating comprises one or more layers.

33. The cutting tool of claim 32 wherein the one or more layers comprise one or more different components.

34. The cutting tool of claim 32 wherein the one or more layers comprise one or more of borides, carbides, carbonitrides and nitrides of the elements from International Union of Pure and Applied Chemistry (TUPAC) groups 4, 5, and 6.

35. The cutting tool of claim 32 wherein the one or more layers comprise one or more of alumina, zirconia, aluminum oxynitride, silicon oxynitride, SiAlON, titanium carbonitride, titanium carbide, cubic boron nitride, silicon nitride, carbon nitride, aluminum nitride, diamond, diamond like carbon, and titanium aluminum nitride.

36. The cutting tool of claim 32 wherein the one or more layers comprise a PVD component.

37. The cutting tool of claim 32 wherein the one or more layers comprise at least one CVD component.

38. The cutting tool of claim 32 wherein the one or more layers comprise at least one lubricious component.

39. The cutting tool of claim 32 wherein the one or more layers comprise at least one CVD component and at least one PVD component.

40. The cutting tool of claim 32 wherein the one or more layers have a total thickness of about 4 μm to about 12μm.

41. A cutting tool for chip forming machining of workpiece materials, the cutting tool comprising:

a rake face over which chips formed during the chip forming machining of workpiece materials flow;

a flank face; and a cutting edge, for cutting into the workpiece materials to form the chips, formed at a junction of the rake face and the flank face, wherein at least the rake face, the flank face, and the cutting edge of the cutting tool comprise a WC-cermet comprising tungsten carbide having a grain size comprising about 0.1 μm to about 10μm and about 0.1 wt. % to about 4 wt. % Co—Ni—Fe-binder comprising about 40 wt. % to about 90 wt. % cobalt, about 4 wt. % to about 36 wt. % nickel, about 4 wt. % to about 36 wt. % iron, and a Ni:Fe ratio of about 1.5:1 to about 1:1.5.

42. A cutting tool for chip forming machining of workpiece materials, the cutting tool comprising:

a rake face over which chips formed during the chip forming machining of workpiece materials flow;

a flank face; and a cutting edge, for cutting into the workpiece materials to form the chips, formed at a junction of the rake face and the flank face, wherein at least the rake face, the flank face, and the cutting edge of the cutting tool comprise a WC cermet comprising tungsten carbide having a grain size comprising about 0.1 μm to about 10 μm and about 8 wt. % to about 9 wt. % Co—Ni—Fe-binder comprising about 40 wt. % to about 90 wt. % cobalt, about 4 wt. % to about 36 wt. % nickel, about 4 wt. % to about 36 wt. % iron, and a Ni:Fe ratio of about 1.5:1 to about 1:1.5.

43. A cutting tool for chip forming machining of workpiece materials, the cutting tool comprising:

a rake face over which chips formed during the chip forming machining of workpiece materials flow;

a flank face; and a cutting edge, for cutting into the workpiece materials to form the chips, formed at a junction of the rake face and the flank face, wherein at least the rake face, the flank face, and the cutting edge of the cutting tool comprise a cermet comprising at least one hard component and about 11 wt. % to about 19 wt. % Co—Ni—Fe-binder comprising about 40 wt. % to about 90 wt. % cobalt, about 4 wt. % to about 36 wt. % nickel, about 4 wt. % to about 36 wt. % iron, and a Ni:Fe ratio of about 1.5:1 to about 1:1.5.

44. The cutting tool of claim 43 wherein the cermet comprises a carbide-cermet.

45. The cutting tool of claim 44 wherein the carbide-cermet comprises a WC-cermet.

46. The cutting tool of claim 45 wherein the WC-cermet further comprises at least one of nitrides and solid solution of carbides and nitrides.

47. The cutting tool of claim 45 wherein the WC-cernet further comprises at least one of TaC, NbC, TiC, VC, $Mo_2C$, $Cr_3C_2$, WC, and solid solution thereof.

48. The cutting tool of claim 45 wherein the WC-cermet comprises about 11 wt. % to about 16 wt. % Co—Ni—Fe-binder.

49. The cutting tool of claim 45 wherein the WC-cermet has a tungsten carbide grain size comprising about 0.1 μm to about 10 μm.

50. The cutting tool of claim 45 wherein the WC-cermet has a tungsten carbide grain size comprising about 0.5 μm to about 5 μm.

51. The cutting tool of claim 45 wherein the Co—Ni—Fe-binder comprises a face centered cubic (fcc) structure that substantially maintains its fcc structure when subjected to plastic deformation thereby exhibiting substantially no stress and strain induced phase transformations.

52. The cutting tool of claim 45 wherein the Co—Ni—Fe-binder comprises a face centered cubic (fcc) structure that substantially maintains its fcc structure when the cermet is subjected to a bending strength test under up to as much as about 2400 megapascal (MPa).

53. The cutting tool of claim 45 wherein the Co—Ni—Fe-binder comprises a face centered cubic (fcc) structure that substantially maintains its fcc structure when the cermet is subjected to up to about 200,000 cycles at up to about 1550 megapascal (MPa) in a cyclic fatigue test in bending at about room temperature.

54. The cutting tool of claim 45 further comprising a coating on at least a portion of the WC-cermnet.

55. The cutting tool of claim 45 wherein the coating comprises one or more layers.

56. The cutting tool of claim 55 wherein the one or more layers comprise one or more different components.

57. The cutting tool of claim 55 wherein the one or more layers comprise one or more of borides, carbides, carbonitrides and nitrides of the elements from IUPAC groups 4, 5, and 6.

58. The cutting tool of claim 55 wherein the one or more layers comprise one or more of alumina, zirconia, aluminum oxynitride, silicon oxynitride, SiAlON, titanium carbonitride, titanium carbide, cubic boron nitride, silicon nitride, carbon nitride, aluminum nitride, diamond, diamond like carbon, and titanium aluminum nitride.

59. The cutting tool of claim 55 wherein the one or more layers comprise a PVD component.

60. The cutting tool of claim 55 wherein the one or more layers comprise at least one CVD component.

61. The cutting tool of claim 55 wherein the one or more layers comprise at least one lubricious component.

62. The cutting tool of claim 55 wherein the one or more layers comprise at least one CVD component and at least one PVD component.

63. The cutting tool of claim 55 wherein the one or more layers have a total thickness of about 4 $\mu$m to about 12 $\mu$m.

* * * * *

UNITED STATES PATENT AND TRADEMARK OFFICE

CERTIFICATE OF CORRECTION

PATENT NO. : 6,010,283
DATED : January 4, 2000
INVENTOR(S) : Hans-Wilm Henrich; Manfred Wolf; Dieter Schmidt; Uwe Schleinkofer It is certified that error appears in the above-identified patent and that said Letters Patent is hereby corrected as shown below:

Title page,
Column 2,
Below "9721844A 6/1997 WIPO," insert

-- Other References

Translation of Cobalt Replacement In Technical Hard Metals, H. Grewe et al.; PTO 99-2840, Translated Apr. 1999.
H. Grewe et al.: "Substitution of Cobalt in Cemented Carbides," Metall (Berlin) (1986), 40(2), 133-40, XP002086162.
Chemical Abstracts, vol. 126, No. 9, Mar. 1997, Abstract No. 121055. (Yoshihiro Minato et al.: "Tungsten Carbide-Based Hard Alloys Having High Impact Resistance for Tools," JP 08 302441 A (Sumitomo Electric Industries, Japan)).
Chemical Abstracts, vol. 114, No. 6, Feb. 1991, Abstract No. 47911. (Noribumi Kikichi et al.: "Manufacture of Surface-Coated Tungsten Carbide-Based Cermets for Cutting Tools," JP02 022454 (Mitsubishi Metal Corp., Japan)).
Chemical Abstracts, vol. 108, No. 12, Mar. 1988, Abstract No. 99568. (Sokichi Taktau et al.: "Alumina-Coated (Mitsubishi Metal Corp., Japan) Sintered Alloys for Cutting Tools," JP 62 047123 (Toshiba Tungaloy Co., LTD, Japan)).
Copies of International Search Reports mailed Dec. 14, 1998, in Application Nos. PCT/IB98/01297, PCT/IB98/01298, PCT/IB98/01299, PCT/IB98/01300, and PCT/IB98/01301, all Filed Aug. 20, 1998.
Thakur, Dr. Babu N., "The Role of Metal Powders in Manufacturing Diamond Tools," SME Technical Paper, MR85-307, Superabrasives '85 Conference, Apr. 22-25, 1985, Chicago, pp. Title Page-17.
Kennametal Inc., Latrobe, PA, "Hot-Press Diamond Matrix Powders," Publication No. ML86-1(2.5)C6, 1986, pp. Title Page-31.
Kennametal Inc., Latrobe, PA, "Infiltration Diamond Matrix Powders," Publication No. ML86-4(3)G6, 1986, Title Page-27.
Macro Division of Kennametal Inc., Port Coquitlam, B.C., Canada, "Cobamet Alloy Powders," Publication No. CT-6086-2, 1986, one page.
Macro Division of Kennametal Inc., Port Coquitlam, B.C., Canada, "Cobamet Alloys," Publication No. AM89-10, 1989, one page.
Table 1, entitled "Cobamet Alloy Powder," one page.
Thummler, F., et al., "Ergebnisse Zur Weiterentwicklung Von Hartstoffen Und Hartmetallen," Proc. Plansee-Semin, 10th (1981), vol. 1, pp. 459-476, Metallwork Plansee GmbH, Reutte, Austria. (English Translation).

UNITED STATES PATENT AND TRADEMARK OFFICE

CERTIFICATE OF CORRECTION

PATENT NO. : 6,010,283
DATED : January 4, 2000
INVENTOR(S) : Hans-Wilm Henrich; Manfred Wolf; Dieter Schmidt; Uwe Schleinkofer It is certified that error appears in the above-identified patent and that said Letters Patent is hereby corrected as shown below:

Holleck, H., et al., 1977 Annual Report, Aufbau, Herstellung, und Eigenschaften hochschmelzender Verbindungen and Systeme (Harstoffe und Hartmetalle), KfK-Ext. 6/78-1, Instititute for Materials and Solid State Research, Kernforschungszentrum in Karlsruhe, Germany, pp. 57-65 including English translation of Oberacker, R., et al., "Properties of Tungsten Carbide Hard Metals with Fe-Co-Ni Binder Alloys, Part I; Effect of the Composition, including Carbon Content," pp. 57-65.
Holleck, H., et al., 1977 Annual Report, Aufbau, Herstellung, und Eigenschaften hochschmelzender Verbindungen and Systeme (Harstoffe und Hartmetalle), KfK-Ext. 6/78-1, Instititute for Materials and Solid State Research, Kernforschungszentrum in Karlsruhe, Germany, pp. 66-77 including English translation of Prakash, L., "Properties of Tungsten Carbide Hard Metals with Fe--Co--Ni Binder Alloys, Part II; Effect of the Heat Treatment," pp. 66-77.
Holleck, H., et al., 1977 Annual Report, Aufbau, Herstellung, und Eigenschaften hochschmelzender Verbindungen and Systeme (Harstoffe und Hartmetalle), KfK-Ext. 6/78-1, Instititute for Materials and Solid State Research, Kernforschungszentrum in Karlsruhe, Germany, pp. 78-86 including English translation of Oberacker, R., et al., "Wettability of Tungsten Carbine By Fe-Co-Ni Binder Alloys," pp. 78-86.
Yin Zhimin et al., "Microstructure and Properties of WC-10 (Fe,Co,Ni) Cemented Carbides," J. Cent.-South Inst. Min. Metall., vol. 25, No. 6, Dec. 1994, pp. 719-722. (English Translation).
Raynor, G. V., et al., "Phase Equilibria in Iron Ternary Alloys, A Critical Assessment of the Experimental Literature," The Institute of Metals, 1988, pp. 247-255.
"Binary Alloy Phase Diagrams," Second Edition, vol. 1.0 ed., Ed. Massalski, T. B. et al, pp. 136-138, 269-270, 355-356, 471-472, 571, 725-727, 835-836, 902-905.
Roebuck, B., et al., "Miniaturised thermomechanical tests on hardmetals and cermets" in ed., Sarin, V., "Science of Hard Materials--5," Proceedings of the 5.sup.th International Conference on the Science of Hard Materials, Maui, Hawaii, Feb. 20-24, 1995, Materials Science and Engineering, Elsevier Publishing Company, vol. A209, Nos. 1-2, pp. 358-365.
Suzuki, H., et al, "Effects of Surface-Grinding on Mechanical Properties of WC--Co Alloy", Journal of the Japan Institute of Metals (1974), vol. 38, No. 7, pp. 604-608 (Japanese Language with some English Translation).
Suzuki, H., et al., "Room-Temperature Transverse-Rupture Strength of WC-10% Ni Cemented Carbide", J. Japan Inst. Met. 41 (6), Jun. 1977, pp. 559-563(Japanese Language with some English Translation).

It is certified that error appears in the above-identified patent and that said Letters Patent is hereby corrected as shown below:

Suzuki, H., et al, Properties of WC-10% (Ni-Fe) Alloys, Department of Metallurgy, Faculty of Engineering, University of Tokyo, Tokyo, pp. 26-31 (Japanese Language with some English Translation).
"Standard Test Method for Flexural Strength of Advanced Ceramics at Ambient Temperature," (Designation: C 1161-90) reprinted from Annual Book of ASTM Standards, American Society for Testing and Materials, Philadelphia, PA.
Prakash, L., et al., "Properties of Tungsten Carbides with Iron-Cobalt-Nickel Alloys as Binders," Sixth International Powder Metallurgy Conference, Dresden, German Democratic Republic, 1977, pp. 39-1-39-16, preprint (German and English Translation).
Thummler, F., et al, "Ergebnisse Zur Weiterentwicklung Von Hartstoffen Und Hartmetallen," (German Language), Proc. Plansee-Semin., 10th (1981), vol. 1, pp. 459-476, Metallwork Plansee GmbH, Reutte, Austria.
Penrice, T., "Alternative Binders for Hard Metals," J. Materials Shaping Technology, vol. 5, No. 1, 1987, pp. 35-39, 1987 Springer-Verlag New York Inc.
Farooq, T. et al., "73 A Study of Alternative Matrices for WC Hardmetals," PM 1990's Int. Conf. Powder Metall. (1990), Issue 2, 388-94, Inst. Met., London, U.K., pp. 388-394.
Holleck, H., et al., 1977 Annual Report, Aufbau, Herstellung, und Eigenschaften hochschmelzender Verbindungen and Systeme (Harstoffe und Hartmetalle), KfK-Ext. 6/78-1, Institute for Materials and Solid State Research, Kernforschungszentrum in Karlsruhe, Germany, pp. 1-140 (pp. 87-94).
"Binary Alloy Phase Diagrams," Second Edition, vol. 2.0 ed., Ed. Massalski, T. B. et al., pp. 971, 1047-50 & 1179-1265, ASM International.
Guillermet, A. F., "The Co-Fe-Ni-W-C Phase Diagram: A Thermodynamic Description and Calculated Sections for (Co-Fe-Ni) Bonded Cemented WC Tools," Z. Metallkd. (1989), 80(2), pp. 83-94.
Crook, P., "Cobalt and Cobalt Alloys," Metals Handbook, Tenth Edition, vol. 2 Properties and Selection: Nonferrous Alloys and Special-Purpose Materials (1990), pp. 446-454, ASM International.
Betteridge, W., "Cobalt and Its Alloys," Ellis Horwood Ltd., Halsted Press: a division of John Wiley & Sons, New York, 1982, pp. 41-59.
"Cobalt Facts," Section 10, Cobalt Supply & Demand 1995, pp. 105-112, The Cobalt Development Institute, Essex, U.K.
"Cobalt Monograph," 1960, pp. 170-240. Ed. Centre D'Information du Cobalt, Brussels, Belgium.

UNITED STATES PATENT AND TRADEMARK OFFICE

CERTIFICATE OF CORRECTION

PATENT NO. : 6,010,283
DATED : January 4, 2000
INVENTOR(S) : Hans-Wilm Henrich; Manfred Wolf; Dieter Schmidt; Uwe Schleinkofer It is certified that error appears in the above-identified patent and that said Letters Patent is hereby corrected as shown below:

Holleck, H., et al., "Constitution of Cemented Carbide Systems," Int. J. Refract. Hard Met. 1, (3), pp. 112-116 (Sep. 1982).
Brabyn, S. M. et al., "Effects of the Substitution of Nickel for Cobalt in WC Based Hardmetal," Proceedings of the 10.sup.th Plansee--Seminar 1981 (Metalwork Plansee, Reutte, Austria, Jun. 1-5, 1981) vol. 2, pp. 675-692, Ed. H. M. Ortner.
Schleinkofer, U., et al., "Fatigue of Cutting Tool Materials," Proceedings of the Sixth International Fatigue Congress, 1996, Berlin, Germany, pp. 1639-1644, "Fatigue '96,'" vol. III, Ed. Lutjering & Nowack.
Schleinkofer, U. et al., "Fatigue of Hard Metals and Cermets," Materials Science and Engineering A209 (1996), pp. 313-317.
Schleinkofer, U. et al., "Microstructural Processes During Subcritical Crack Growth in Hard Metals and Cermets under Cyclic Loads," Materials Science and Engineering A209 (1996), pp. 103-110.
Schleinkofer, U., "Fatigue of Hard Metals and Cermets Under Cyclically Varying Stress," (German Language and English Translation), Thesis submitted to the Techical Faculty of the University of Erlangen-Nurnberg, 1995, pp. 11-12, 96-100, 199-203, & 207.
Schleinkofer, U. et al., "Fatigue of Hard Metals and Cermets--New Results and a Better Understanding," Int'l J. of Refractory Metals & Hard Materials 15 (1997), pp. 103-112.
Schleinkofer, U. et al., "Fatigue of Hard Metals and Cermets--The Present Knowledge and its Technical Importance and Application," Proceedings of the 1996 World Congress on Powder Metallurgy & Particular Materials, pp. 18-85 to 18-96, reprinted from Advances in Powder Metallurgy & Particulate Materials--1996.
Brookes, K. J. A., "World Directory and Handbook of Hardmetals and Hard Materials," Sixth Edition, International Carbide Data, pp. D15, D19, D31, D38, D44, D63, D78, D79, D82, D87, D96, D143, D175, D182, D223, D234, D327A.
Moskowitz, D. et al., "High-Strength Tungsten Carbides," International Journal of Powder Metallurgy 6(4) 1970, pp. 55-64.
Prakash, L. J., "The Influence of Carbide Grain Size and Binder Composition on the Properties of Cemented Carbides," Horizons in Powder Metallurgy (Proc. Of the 1986 International PM Conf. And Exhibition, Dusseldorf, Jul. 7-11, 1986) Part 1, pp. 261-264 (1986).
Prakash, L. et al., "The Influence of the Binder Composition on the Properties of WC-Fe/Co/Ni Cemented Carbides," Mod. Dev. Powder Metall. (1981), 14, pp. 255-68.

It is certified that error appears in the above-identified patent and that said Letters Patent is hereby corrected as shown below:

Roebuck, B., "Magnetic Moment (Saturation) Measurements of Hardmetals," National Physical Laboratory, Dec. 1994, DMM(A)146, pp. 1-12.
Guilemany, J. M., et al., "Mechanical-Property Relationships of Co/WC and Co-Ni-Fe/ WC Hard Metal Alloys," International Journal of Refractory Metals and Hard Materials 12 (1993-1994), pp. 199-206.
Gabriel, A., et al., "New Experimental Data in the C Fe-W,-Co/W, C-Ni-W, C-Fe-Ni-W and C-Co-Ni-W Systems Application to Sintering Conditions of Cemented Carbides Optimization of Steel Binder Composition by Partial Factorial Experiments," Int. Inst. Of the Science of Sintering Conf. Held at Herceg-Novi, Yugoslavia (Sep. 1985), pp. 379-393, published by Plenum Press.
Herceg-Novi, Yugoslavia (Sep. 1985), pp. 379-393, published by Plenum Press.
Gabriel, A. et al., "New Experimental Data in the C-Co-W, C-Fe-W C-Fe/Ni-W And C-Co/Ni-W Systems and Their Applications to Sintering Conditions," 11.sup.th International Plansee Seminar '85, (May 20-24, 1985, Reutte, Tirol, Austria), vol. 2, pp. 509-525, Ed. H. Bildstein & H. M. Ortner.
Mankins, W. L., et al., "Nickel Alloys," Metals Handbook, Tenth Edition, vol. 2, Properties and Selection: Nonferrous Alloys and Special-Purpose Materials (1990), pp. 428-445, ASM International.
Uhrenius, B., et al., "On the Composition of Fe-Ni-Co-Wc-Based Cemented Carbides," International Journal Of Refractory Metals And Hard Materials 15 (1997), pp. 139-149.
Schubert, W-D., et al., "Phase Equilibria in the Systems Co-Mo-W-C and Ni-Mo-W-C," Translated from German, High Temperatures--High Pressures, 1982, Vo. 14, pp. 87-100.
Raynor, G. V., et al., "Phase Equilibria in Iron and Ternary Alloys, A Critical Assessment of the Experimental Literature," The Institute of Metals, 1988, pp. 7, 15, 16, 27-34, 71-80, 140-142, and 213-288.
Prakash, L., "Properties of Tungsten Carbides with an Iron-Cobalt-Nickel Binder in Sintered and Heat-Treated States" (German Language and English Translation), KFK-Nachr. (1979), 11(2), pp. 35-42, Inst. Mater.-Festoerperforsch., Karlsruhe, Germany.
Sundman B., et al., "The Thermo-Calc Databank System," Calphad, vol. 9, No. 2, 1985, pp. 153-190.
Doi, A. et al., "Thermodynamic Evaluation of Equilibrium Nitrogen Pressure and WC Separation in Ti-W-C-N System Carbonitride," 11.sup.th International Plansee Seminar '85 (May 20-24, 1985, Reutte, Tirol, Austria), vol. 1, pp. 825-843, Ed. H. Bildstein & H. M. Ortner.

UNITED STATES PATENT AND TRADEMARK OFFICE

CERTIFICATE OF CORRECTION

PATENT NO. : 6,010,283
DATED : January 4, 2000
INVENTOR(S) : Hans-Wilm Henrich; Manfred Wolf; Dieter Schmidt; Uwe Schleinkofer It is certified that error appears in the above-identified patent and that said Letters Patent is hereby corrected as shown below:

Gustafson, P., "Thermodynamic Evaluation of C--W System," Materials Science and Technology, Jul. 1986, vol. 2, pp. 653-658.
Prakash, L. J., "Weiterentwicklung von Wolframcarbid Hartmetallen unter Verwendung von Eisen-Basis-Bindelegierungen [Development of Tungsten Carbide Hardmetals Using Iron-Based Binder Alloys]," KfK 2984, Institute for Materials and Solid States Research by Kernforschungszentrum in Karlsruhe, Germany, 1980, pp. 1-221(German Language).
Ramqvist, L., "Wetting of Metallic Carbides by Liquid Copper, Nickel, Cobalt and Iron," International Journal of Powder Metallurgy 1 (4), 1965, pp. 2-21.
Warren, R., "The Wetting of the Mixed Carbide, 50 w/o WC/50 w/o TiC by Cobalt, Nickel and Iron and Some of Their Alloys," International Journal of Powder Metallurgy 4 (1), 1968, pp. 51-60.
Yin Zhimin et al., "Microstructure and Properties of WC-10 (Fe,Co,Ni) Cemented Carbides," J. Cent.-South Inst. Min. Metall., vol. 25, No. 6, Dec. 1994, pp. 719-722.
Zhang Li, et al, "A New Hardmetal for Mining with Ni-Co Binder," Int. J. of Refractory Metals & Hard Materials 14 (1996), pp. 245-248. --.

Signed and Sealed this

Twenty-seventh Day of November, 2001

*Attest:*

Nicholas P. Godici

*Attesting Officer*

NICHOLAS P. GODICI
*Acting Director of the United States Patent and Trademark Office*